United States Patent [19]

Vogelsang

[11] 4,130,968

[45] Dec. 26, 1978

[54] MECHANISM FOR CONTROLLING MOVEMENTS OF A TOOL

[76] Inventor: Alois Vogelsang, Karl Anton Srasse 3, Dusseldorf, Germany, D-4000

[21] Appl. No.: 777,046

[22] Filed: Mar. 14, 1977

[51] Int. Cl.[2] ..... B24B 17/00

[52] U.S. Cl. ..... 51/100 R; 318/578

[58] Field of Search ..... 51/100 R, 101, 165.89; 90/62; 74/569; 318/663, 578

[56] References Cited

U.S. PATENT DOCUMENTS

| | | | |
|---|---|---|---|
| 3,285,137 | 11/1966 | Hill | 90/62 |
| 3,433,122 | 3/1969 | Wachter | 90/62 X |
| 3,743,910 | 7/1973 | Wise | 318/578 |
| 3,834,084 | 9/1974 | Sakane | 51/101 R |
| 3,980,938 | 9/1976 | Nakagoshi | 318/578 |

*Primary Examiner*—Nicholas P. Godici

*Attorney, Agent, or Firm*—Norman P. Friederichs

[57] ABSTRACT

A mechanism is provided for controlling movements of the tool of a machine tool. The mechanism includes a fixed template and a template follower which is automatically pressed against the template. The template and follower are housed independently of and at a distance from the tool holder. Movement of the follower is analyzed into components along at least two coordinates and these components are transmitted electrically to the tool holder.

8 Claims, 3 Drawing Figures

MECHANISM FOR CONTROLLING MOVEMENTS OF A TOOL

BACKGROUND OF THE INVENTION

The invention relates to a mechanism for controlling movement of the tool of a machine tool using a follower which travels along a stationary template.

In known machine tools having such a mechanism, a follower which is fixed on a tool holder travels along a stationary template, and the tool for machining the work-piece is moved along the path travelled by the follower. Electronic controls are known for this purpose, in which the follower is dirigible and transmits electrical signals to the driving mechanism of the adjustable tool holder which correspond to the deflections occurring when the template is followed, thereby to alter the position of the tool in relation to the work-piece to correspond to the contour of the template. The shape of the follower must exactly match the shape of the working surface of the tool, so that the movements of the tool coincide exactly with those of the follower. Since the follower is firmly connected to the tool holder at a fixed distance from the tool, it can only be brought into contact with the shaped template for beginning work by switching on the drive motors of the tool support. In the event of inexpert adjustment or of too rapid a start-up, the follower can easily break off. The shaped template must also be protected from cuttings which are flying around and this restricts viewing of the tool and the work-piece as well as of the template and the follower.

OBJECTS OF THE INVENTION

The known electronic controls are very sensitive to disturbance but operate satisfactorily if sufficient protective measures are taken against contamination of the template.

However, they are very expensive. An object of the present invention is to provide a control mechanism for machine tools, which, insofar as the conditions regarding the position allow, may be arranged on the machine to controlled itself or independently of the machine in a protected position. A further object is to provide a further control mechanism which may easily be protected from contamination. Yet a further object is to provide a control mechanism in which the risk of damage through inexpert operation may be minimised.

SUMMARY OF THE INVENTION

According to the invention there is provided a mechanism for controlling movements of a tool mounted in a tool holder of a machine tool, the mechanism comprising a fixed template, a template follower which is automatically pressed on to the template and is housed independently and at a distance from the tool holder, and means for electrically conveying to the tool holder separate information about the movement of the follower along each of a plurality of coordinates.

Since, in accordance with the invention, the template may be completely separated from the tool holder, the control mechanism may be totally protected from contamination without hindering observation of the tool and the work-piece. The control mechanism according to the invention may also be subsequently installed on already existing machines without difficulty, is not expensive, is particularly fail-safe, and is less sensitive to disturbance than know electronic controls.

If the template is made of ferromagnetic material and if the follower which is fixed on a cross-slide rest, has a permanent magnet, the follower always lies against the surface of the template and it thus follows the template accurately. According to a preferred embodiment of the invention the permanent magnet is rod-shaped or cylindrical and is mounted on the cross-slide rest so as to be rotatable about its longitudinal axis, and is provided with a rotary drive. The follower therefore rotates as it moves along the template, thus increasing the accuracy of following since there is no risk of slippage occurring between the follower and the template.

The magnet may be any type of magnet which produces its lines of magnetic force substantially only at one end, and expediently only on the upper end. Although the invention is preferably carried out using only a permanent magnet, it is optionally possible also to insert an electromagne The movements of the cross-slide rest caused by the movement of the follower along the template, this rest also optionally being arranged on a slide which moves perpendicularly to its plane of movement so as to allow three-dimensional movement, are detected by distance measuring devices, such as for example individual helical potentiometers, associated with each of the slides, and are converted into electrical signals which are in turn fed to the drive motors or control motors of the tool support, so that these motors regulate the slides supporting the tool to correspond to the movements of the follower.

The tool is appropriately supported on a similar cross-slide rest and optionally on a third slide which allows a third dimension of movement. Distance measuring devices such as helical potentiometers are also associated with these slides and they are electrically connected both to the distance measuring devices of the follower and to the relevant servomotors of the respective slide of the tool holder so that they allow the relevant servomotor to operate until there is not adjustment between the two associated distance measuring devices of the follower and the tool. As soon as the associated distance measuring devices are accurately aligned, the relevant driver motor for the slide of the tool support is adjusted so that this slide is not stationary, until the corresponding slide of the follower support carried out another movement. The invention thus allows the sliding movements of the follower support to produce corresponding sliding movements in the tool holder directly and without any time delay.

The traversing movements of the individual slides are preferably mechanically transferred to the distance measuring devices which are associated with these slides via a toothed rack which is mounted on the relevant slide and a pinion which is connected to the distance measuring device. The distance measuring device may thus be situated in such a way that the pinion reliably engages the rack without backlash.

BRIEF DESCRIPTION OF THE DRAWINGS

An embodiment of the control mechanism according to the invention is shown diagrammatically in the drawings.

DETAILED DESCRIPTION OF PREFERRED EMBODIMENT

Figure 1:
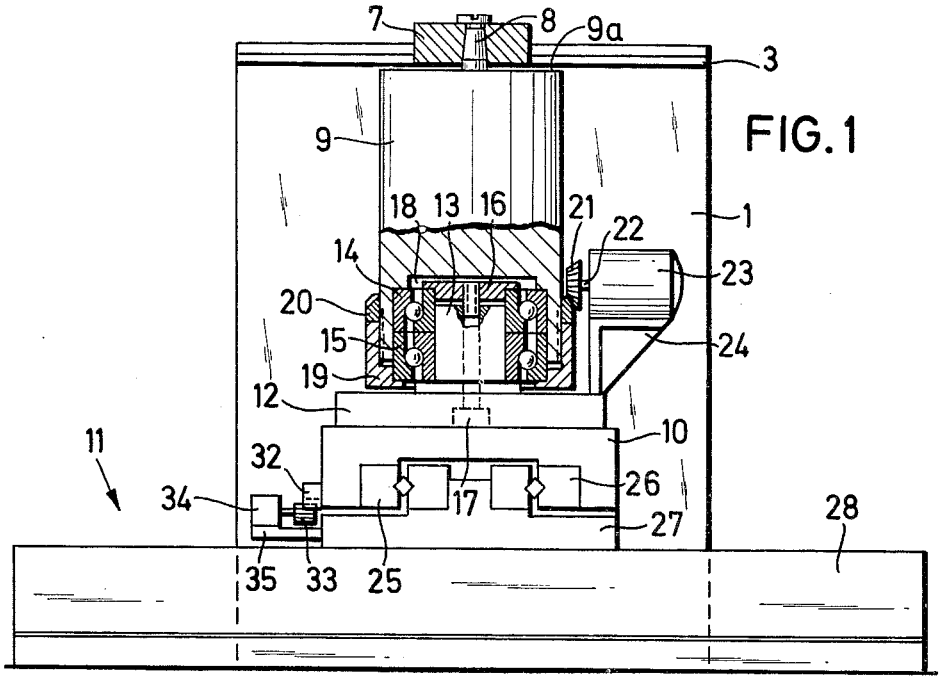
FIG. 1 shows a partially cut away front view of a follower mechanism which is situated on a cross-slide rest, is provided with a permanent magnet, and follows a stationary template.
Figure 3:
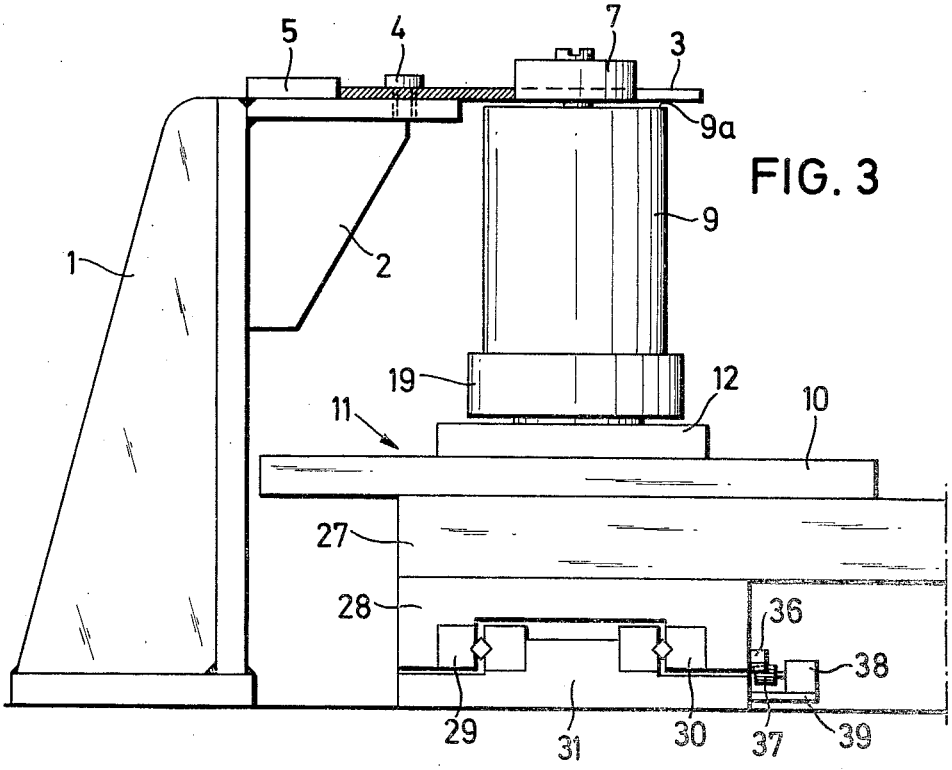
FIG. 3 is a side view of the mechanism of FIGS. 1 and 2.
Figure 2:
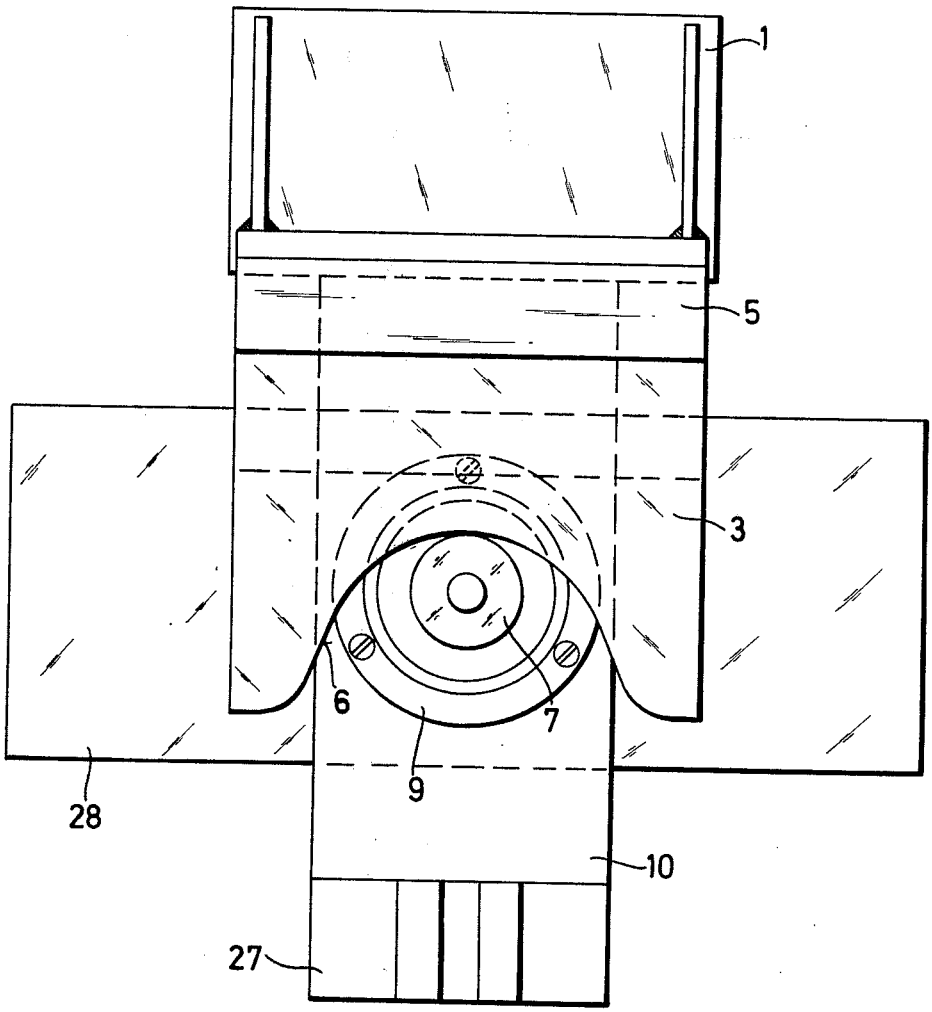
FIG. 2 is a plan view of the mechanism of FIG. 1.

The mechanism shown in the drawings is to be arranged on or outside a machine tool as a structural unit at a distance from the tool holder and can for example be covered by a transparent hood and thus be protected from contamination.

A plate-like template 3 is detachably mounted on a bracket 2 connected to a post 1, by means of screws 4. The template 3 lies against a stop 5 and is thus fixed exactly in position.

The periphery 6 of the template 3 is followed by a cylindrical template follower 7 which is deteachably mounted on a pivot 8 extending upwardly from a cylindrically shaped permanent magent 9. For each tool, a follower whose diameter exactly matches the working width of the tool, for example a grinding wheel, is used. the magnet 9 is mounted for rotation about its longitudinal axis on a slide 10 of a cross-slide rest 11.

The slide 10 bears on its upper side a cap 12 having an upwardly extending bearing journal 13 upon which two ball-bearings 14 and 15 are mounted. The ball-bearings 14 and 15 are fixed on the bearing journal 13 by means of a conical spring washer 16 and a screw 17.

The bearing journal 13 is received in a recess 18 which is situated at the lower end of the cylindrical permanent magnet 9. A screw cap 19 is screwed on to the lower end of the permanent magnet 9, this cap locating the external race of the ball-bearing 14 and 15 in the recess 18.

A toothed wheel 20 in which a pinion 21 engages is fixed on the exterior of the permanent magent 9 above the cap 19. The pinion 12 is fixed to a drive shaft 22 of an electric motor 23. The electric motor 23 is fixed on a bracket 24 which in turn is secured on the cap 12.

The electric mctor 23 rotates the permanent magnet 9 via the pinion 21 and the toothed wheel 20 at such a velocity that the follower 7 on the periphery 6 of the template 3 moves at the desired rate of feed of the tool [not shown], for example a grinding wheel, and thus follows the template exactly. Since the lines of magnetic force which isue from the upper end 9*a* of the permanent magnet 9 pass through the template 3, which is arranged tightly above this end and is made of ferromagnetic material, and return through the follower 7, which is also made of ferromagnetic material, into the permanent magnet 9, the follower 7 is guaranteed always to be pressed firmly against the periphery 6 of the template 3. Thus the periphery of the template is traced accurately and without backlash. Since the permanent magnet 9 is situated on the cross-slide rest 11, it can carry out the movements required for tracing the template 3 without hindrance so that the electric motor 23 serves merely as adrive.

The slide 10 is situated on a bed 27 and is movable in a longitudinal direction by means of rolling bearings 25 and 26. The bed is fixed on another slide 28 which extends at right angles to the bed and which is supported on another bed 31 and is movable longitudinally by means of rolling bearings 29 and 30. This cross-slide rest 11 can be placed on another slide [not shown] which is situated so as to be movable in a vertical direction.

The longitudinal movements of the slide 10 are transferred to a pinion 33 which engages in a toothed rack 32 fixed on one side of the slide. The pinion is fixed to a helical potentiometer 34 or other electrical distance measuring devices, which is mounted on a bracket 35 fixed on the bed 27.

The longitudinal movements of the slide 28 are similarly transferred to a pinion 37 which engages in a toothed rack 36 fixed on one side of the slide, this pinion being fixed to a helical potentiometer 38 or other electrical distance measuring device which is mounted on a bracket 39 fixed on the bed 31.

The helical potentiometers 34 and 38 are each electrically connected to the drive motor [not shown] of a respective slide of a second compound rest [not shown], this compound rest carrying the tool whose path of movement is to be the same as the periphery of the template. The two slides of this second compound rest are also equipped in a similar manner to the slides 10 and 27 with similar helical potentiometers, the helical potentiometers of the slides of the template following device each being electrically connected to the respective potentiometer of the tool support. In displacing the slide 10, its associated helical potentiometer 34 is regulated so that no more adjustment is given with te helical potentiometer of the corresponding slide of the tool support. A control signal is simultaneously given on the drive motor of this slide, which is now activated and which tracks the relevant slides of the tool support corresponding to the displacement of the slide 10. As soon as the two associated helical potentiometers coincide again, the drive motor for the slides is switched off. Control of the slide 28 takes place in a corresponding manner.

A helical potentiometer may be associated with each slide for each of the two possible directions of movement, if this is technically desirable for control.

The invention enables the movements of the follower device which is composed of the permanent magnet 9 and the follower 7 to be transferred without backlash to the compound rest or its two slides supporting the tool to be controlled, so that the template is accurately followed and an accurate control of the following process may be carried out without requiring the use of a complicated electronic device. Since the control mechanism can be arranged as a structural unit, for example covered by a transparent hood, and at a distance from the tool, it does not impair observation of the tool and the work-piece and it cannot cause contamination. This latter feature is of particular significance, since with the high degree of accuracy in control of the drive motors moving the tool holder, even the smallest particle of dirt on the periphery of the template can cause faults in the machining of work-piece.

I claim:

1. A mechanism for controlling movement of a tool mounted in a tool holder of a machine tool, the mechanism comprising a fixed template, a template follower which is pressed onto the the template and is housed at a distance from the tool holder, and means for electrically conveying to the tool holder separate information about the movement of the follower along each of a plurality of coordinates;

said follower being mounted on a cross-slide rest having two slides which are movable in a single plane perpendicularly to each other and said follower further being situated on another slide which is movable in a plane which is perpendicular to the first mentioned plane;

said tool holder being provided with a cross-slide rest having a plurality of slides which correspond to the slides of the cross-rest in which the follower is mounted, said tool holder slide being provided with a drive to enable the tool holder to perform movements, each of said tool holder slides being controllably coupled to a corresponding slide of the follower; and said controllable coupling being effected by a toothed rack, a pinion engaging the said rack, and an electrical distance measuring device operably connected to the pinion, associated with each slide, the electrical distance measuring devices of associated slides being connected to each other and to the drive of the associated slide of the tool holder.

2. A mechanism according to claim 1, wherein the template, the follower and a support for the follower are located as a unit in an enclosed housing.

3. A mechanism for controlling movements of a tool mounted in a tool holder of a machine tool, the mechanism comprising a fixed template made of ferromagnetic material, a template follower comprising a generally cylindrical permanent magnet rotatably driven and mounted on a cross slide rest which is pressed onto the template and is housed at a distance from the tool holder, and means for electrically conveying to the tool holder separate information about the movement of the follower along each of a plurality of coordinates, said cross-slides rest having two slides which are movable in a single plane perpendicularly to each other and a third slide which is movable in a plane which is perpendicular to the first mentioned plane and the tool holder being provided with a cross-slide rest having one slide corresponding to each slide of the cross-slide rest on which the follower is mounted, the tool holder slides are provided with a drive to enable the tool holder to perform movements, and each of the tool holder slides is controllably coupled to a corresponding slide of the follower by means of a toothed rack, a pinion engaging the said rack, and an electrical distance measuring device operbly connected to the pinion, associated with each slide, the electrical distance measuring devices of associated slides being connected to each other and to the drive of the associated slide of the tool holder.

4. A mechanism according to claim 3, wherein the follower is detachably mounted on the upper end of the permanent magnet.

5. A mechanism according to claim 4, wherein the follower is made of ferromagnetic material.

6. A mechanism according to claim 3, wherein the permanent magnet is provided with rolling bearings which connect it to the cross-slide rest.

7. A mechanism according to claim 3, wherein the permanent magnet carries a toothed rack in which a pinion which is fixed on a drive shaft of a motor engages.

8. A mechanism according to claim 3, wherein the said distance measuring devices are helical potentiometers.

* * * * *

UNITED STATES PATENT AND TRADEMARK OFFICE

CERTIFICATE OF CORRECTION

PATENT NO. : 4,130,968

DATED : December 26, 1978

INVENTOR(S) : Alois Vogelsang

It is certified that error appears in the above-identified patent and that said Letters Patent are hereby corrected as shown below:

In the Specification:

Column 1, line 43, after "to" insert --be--
Column 1, line 48, change "minimised" to --minimized"
Column 2, line 18, change "electromagne" to --electromagnet.--
Column 3, line 16, change "deteachably" to --detachably--
Column 3, line 18, change "magent" to --magnet--
Column 3, line 21, change "the" to --The--
Column 3, line 35, change "magent" to --magnet--
Column 3, line 45, change "isue" to --issue--
Column 4, line 22, change "te" to --the--

In the Claims:

Claim 3, column 6, line 10, change "operbly" to --operably--

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*